United States Patent [19]

Troman et al.

[11] Patent Number: 4,471,499

[45] Date of Patent: Sep. 18, 1984

[54] CISTERN FLUSH VALVE ASSEMBLY

[75] Inventors: Philip Troman, Streetly; Brian E. Carrington, Blakenhall, both of England

[73] Assignee: C. H. Edwards Limited, Millfields, England

[21] Appl. No.: 477,771

[22] Filed: Mar. 22, 1983

[30] Foreign Application Priority Data

Oct. 28, 1982 [GB] United Kingdom ..... 8230866

[51] Int. Cl.[3] ..... E03D 1/34

[52] U.S. Cl. ..... 4/393; 4/378; 4/400

[58] Field of Search ..... 4/378, 390–395, 4/397–400

[56] References Cited

U.S. PATENT DOCUMENTS

| | | | |
|---|---|---|---|
| 2,632,895 | 3/1953 | Teahan | 4/399 |
| 3,368,224 | 2/1968 | Ament . | |
| 3,587,117 | 6/1971 | Ward | 4/385 |
| 3,988,785 | 11/1976 | Schoepe et al. | 4/393 X |

FOREIGN PATENT DOCUMENTS

| | | | |
|---|---|---|---|
| 1955889 | 2/1967 | Fed. Rep. of Germany . | |
| 993216 | 5/1965 | United Kingdom | 4/399 |

*Primary Examiner*—Charles E. Phillips

*Attorney, Agent, or Firm*—Neuman, Williams, Anderson & Olson

[57] ABSTRACT

A self-contained replacement flush valve assembly has an annular valve seat member which is sealed to the original valve seat by an elastomeric sealing ring, the valve seat member being clamped in position by a toggle assembly mounted on a screw carried by a frame received in the cistern outlet tube. The frame is of H-shape and its upper limbs are pivotally connected to the valve seat member, the lower limbs having a sliding engagement with pivoted arms of the toggle assembly to resist rotation of the toggle assembly. The toggle arms are pivotally retracted during insertion of the toggle assembly and frame into the outlet tube, but fall into extended positions so that on tightening the screw the arms clamp against the lower end of the outlet tube.

9 Claims, 7 Drawing Figures

CISTERN FLUSH VALVE ASSEMBLY

This invention relates to cistern flush valve assemblies and particularly, but not exclusively, to a replacement flush valve assembly which may be readily fitted to a cistern by a relatively unskilled person.

A self-contained replacement flush valve assembly, of the 'flapper' kind which are widely used in U.S.A. and Canada, was proposed in U.S. Pat. No. 3,988,785. That valve assembly employs a replacement valve seat which is coated on its underside with a waterproof sealant to secure the replacement seat to the original seat. The replacement valve seat also acts as a pivotal support for a valve flap. The waterproof sealant is relied upon to secure the valve assembly to the cistern. Whilst this arrangement can work satisfactorily in practice it is necessary to clean and dry the original seat carefully if a satisfactory bond is to be obtained. When the original seat is formed of ceramic it is necessary to use a different composition of sealant from that which is suitable for a plastics seat, and this often requires the use of an adaptor ring.

It has also been proposed in U.S. Pat. No. 3,587,117 to secure an original flush valve seat to a cistern by means of various toggle arrangements. In one proposed construction a tie rod is fixedly secured at its lower end to a rigid toggle, the tie rod carrying a nut at its upper end. With that arrangement the toggle and tie rod must be assembled into position from below the cistern, and this would not be acceptable for a replacement seat for fitting by an unskilled person. In a second arrangement shown in that specification a series of toggles is employed, and these would be difficult to assemble into position if access could not be gained to the underside of the cistern outlet.

The present invention stems from attempts to design a replacement flush valve seat which can be readily secured in sealing engagement with a cistern outlet by a relatively unskilled person working from the interior of the cistern.

According to the invention a flush valve seat assembly comprises an annular valve seat member provided on the upper surface thereof with an upwardly facing valve seat, a resilient sealing ring carried by the valve seat member and presenting a downwardly facing sealing surface for engagement with the annular upper end of a cistern outlet tube, a frame connected to and extending downwardly from the valve seat member for positioning substantially within the outlet tube, a downwardly extending screw carried by the frame, a toggle assembly carried by the lower end of the screw and comprising a toggle body threadedly engaged with the screw, and at least one toggle arm which is pivoted with respect to the toggle body to enable the toggle assembly to be passed through the outlet tube from the upper end thereof with the toggle arm pivotally retracted and the toggle arm to be extended to lie beneath the lower end of the outlet tube.

Preferably the toggle assembly comprises two such pivoted toggle arms.

After the toggle arms have been extended beneath the outlet tube tightening of the screw will draw the toggle assembly towards the valve seat member to bring the toggle arms into firm engagement with the lower end of the outlet tube, thereby resiliently deforming the sealing ring into firm sealing engagement with the upper end of the outlet tube. This enables an efficient seal to be made between the valve seat member and the outlet tube.

The head of the screw may readily be arranged to be accessible for engagement by a screw driver or other convenient tool inserted downwardly through the bore of the valve seat member.

Preferably the frame comprises a substantially C-shaped portion lying on its back with the free ends of the C secured to the valve seat member, and the screw passing through the back of the C and such that the head of the screw is positioned a substantial distance below the level of the sealing ring. This construction enables the lower portion of a float to be received within the upper part of the outlet tube, above the screw, in arrangements which employ a float in conjunction with the valve member.

Preferably the frame is provided with abutment means engageable by the toggle assembly to prevent rotation of the toggle assembly on tightening of the screw.

In one preferred construction the frame is provided with a pair of downwardly extending frame members which extend through respective apertures in the toggle arms, but in another preferred construction the toggle body is provided with a pair of upwardly extending limbs which pass through respective apertures in the frame.

The toggle arms are preferably pivotally connected to the toggle body by horizontal pivots which are sufficiently loose to ensure that the arms will fall into their extended position in the manner of latches once they have passed through the outlet tube, the toggle body being provided with respective stop means engageable by the respective arms in their extended positions to prevent further downward pivotal movement of the arms.

Preferably the frame is pivotally connected to the valve seat member to enable the sealing ring to seal against an outlet tube upper end that lies in a plane inclined with respect to the axis of the outlet tube, whilst the frame extends substantially axially of the outlet tube.

Although the valve seat assembly may be provided independently of a valve member for engagement with the valve seat, it is preferred that the valve seat assembly is part of a self-contained valve assembly in which the valve member is pivotally carried by said valve seat member. This enables a householder to replace an existing valve member and to renew the existing valve seat by installing the self-contained assembly in a simple manner. This can be achieved with the minimum of tools, usually only a screwdriver being necessary, and since a positive sealing action is effected between the sealing ring and the old valve seat there is usually no need to clean the old valve seat before securing the new valve assembly in place. Since the valve assembly is self-contained correct alignment of the new valve seat with the valve member is ensured to restore leak-proof operation of the valve.

Of course, the valve seat assembly alone, or the self-contained valve assembly may also be used as original equipment in a cistern.

A self-contained replacement flush valve assembly, and a modification thereof, in accordance with the invention will be described, by way of example only, with reference to the accompanying drawings in which.

Figure 1:
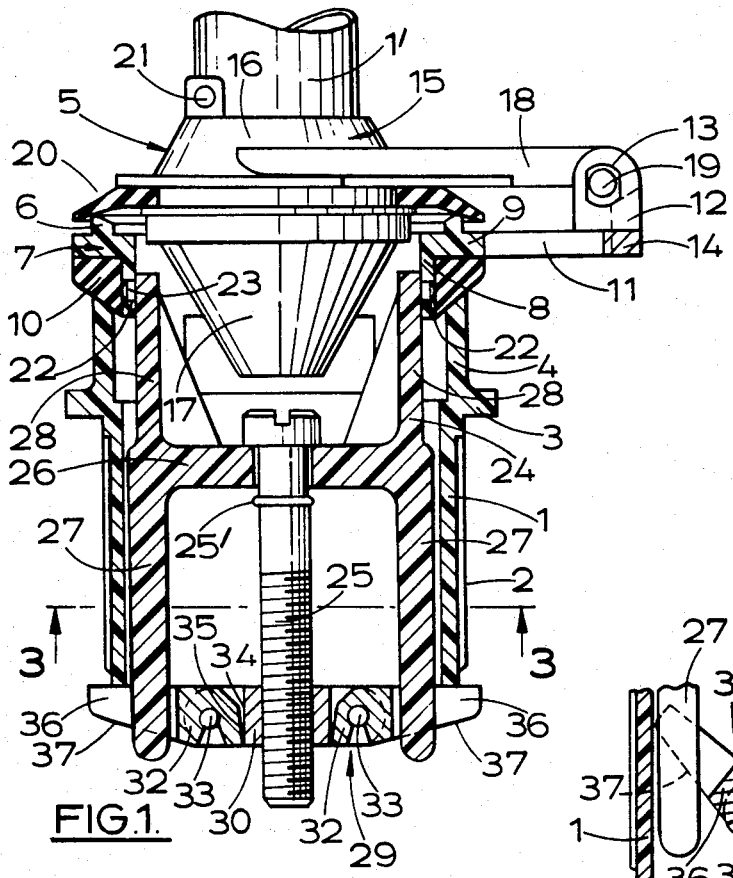
FIG. 1 is a vertical cross-sectional view of the flush valve assembly in its installed position secured to an existing cistern outlet tube.
Figure 2:
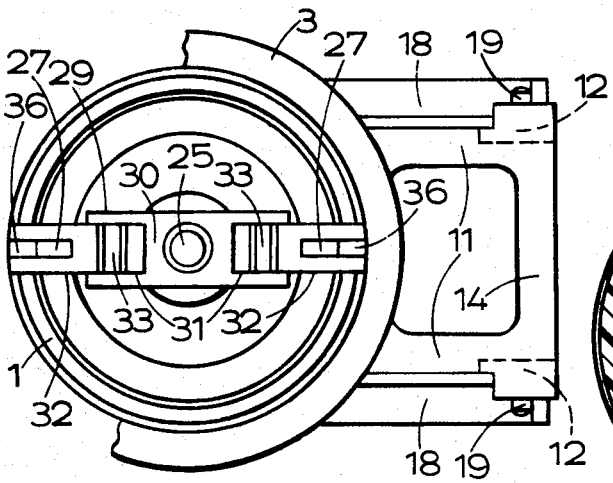
FIG. 2 is an under-plan partial view of the assembly of FIG. 1.
Figure 3:
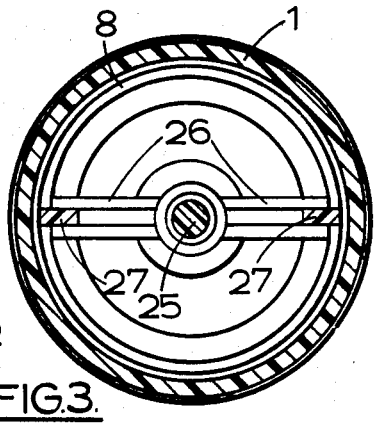
FIG. 3 is a section on the line 3—3 of FIG. 1.

With reference to FIGS. 1 to 3, an existing cistern outlet tube 1 is of the usual type, provided with an externally threaded lower portion 2 beneath a flange 3 which in use abuts a resilient seal, not shown, engaging with the cistern floor. The annular upper end 4 of the outlet tube acted as a valve seat in the original flush valve assembly, but does not act as a valve seat when the replacement flush valve assembly has been secured in place. An overflow tube 1' connects with outlet tube 1 below upper end 4, best seen in the modified arrangement of FIG. 5.

It will be appreciated that prior to installation of the replacement flush valve assembly it is necessary to remove the original valve flap, or equivalent valve member, because the replacement assembly is a self-contained unit which comprises both a new valve member 5 and a new valve seat 6.

The replacement valve assembly comprises a moulded plastics annular valve seat member 7 of substantially L-section in transverse cross-section, comprising a tubular portion 8 and a radially outwardly directed flange portion 9 depending from the upper end of the tubular portion 8. Valve seat 6 is provided by an integral annular upwardly extending cylinder on the upper face of flange portion 9. A resilient annular sealing ring 10 of substantially triangular cross-section is fitted within the angle of the L-section valve seat member 7 to effect a seal between the upper end 4 of the outlet tube 1 and the valve seat member 7.

A pair of parallel horizontal arms 11 extend integrally from flange portion 9. The outer ends of the arms 11 are provided with respective upstanding pivot lugs 12 incorporating outwardly extending flap stops and having respective upwardly elongated eyes 13, and the arms 11 are integrally connected by a bridge piece 14.

Valve member 5 is in the form of a pivoted flap and is of substantially conventional construction, comprising a plastics float 15 consisting of upper and lower frusto-conical shells 16, 17 respectively, the upper shell 16 having integral flap arms 18 carrying respective trunnion pins 19 which are loosely received in the respective eyes 13. The shells 16 and 17 are sealably secured together in suitable manner and are shaped to define an external annular recess in which is firmly seated the radially inner margin of a resilient valve seal 20 which is engageable with the valve seat 6 to close the interior of the cistern outlet tube 1 from the cistern volume. Shell 16 is also provided with an eye 21 to receive a pull cord for connection to the existing flush valve lever.

The lower end of tubular portion 8 is provided with two diametrically opposed pivot holes 22 which receive respective trunnions 23 on a frame 24. Frame 24 is of moulded plastics and is of substantially H-shape, the trunnions 23 being provided at the upper ends of the respective upright arms 28 of the H. The upper half of the frame, that portion which is of substantially C-shape, is relatively wide in the circumferential direction of tube 1 to support a vertical toggle screw 25 of plastics which extends downwardly through the horizontal back portion 26 of the C, whereas the lower legs 27 of the H-shape are relatively slim in the circumferential direction but are substantially wider than arms 28 in the radial direction of tube 1.

A toggle assembly 29 comprises an elongate plastics toggle body 30 which is threadedly engaged at its centre with the lower end of toggle screw 25 and, as is best seen in FIG. 2, is provided with a pair of diametrically opposed, radially outwardly facing vertical slots 31 in each of which is pivoted the radially inner end of a respective one of a pair of plastics toggle arms 32, which constitute latch members. Pivot pins 33 are preferably moulded integrally with the toggle body 30, and the arms 32 are provided with downwardly directed slots which are necked to provide a snap engagement on assembly between the arms 32 and the pivot pins 33. The radially inner ends 34 of the slots and the radially inner ends 35 of the toggle arms 32 are shaped to permit upward pivotal movement of the arms relative to the toggle body, as seen in FIG. 4, but to provide abutment between the respective surfaces 34, 35 when the arms are in the horizontal position shown in FIG. 1, thereby to prevent the arms from pivoting further downwardly with respect to the toggle body 30.

The radially outer half of each toggle arm 32 is provided with a respective vertical, radially outwardly facing slot 36 which slidably receives the lower end of a respective frame leg 27. The function of the frame legs 27 is to prevent rotation of the toggle assembly 29 with respect to the frame 24 during initial tightening of screw 25.

Figure 4:
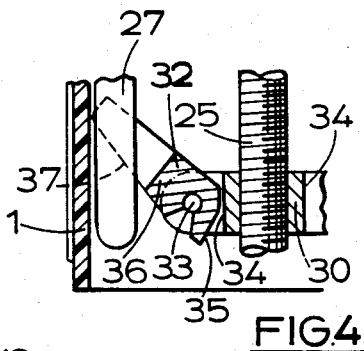
FIG. 4 is a partial view corresponding to FIG. 1 but showing the arrangement of the toggle assembly whilst passing through the outlet tube.

When the replacement valve assembly is offered to the upper end 4 of the outlet tube 1 the toggle arms are each pivoted upwards relative to the toggle body by the engagement between an inclined face 37 on the toggle arm and tube end 4, to enable the toggle assembly to pass downwards through the tube 1, as shown in FIG. 4. An annular rib 25' on screw 25 prevents upward movement of the screw relative to portion 26 of frame 24 during this operation. Prior to insertion of the valve assembly into the tube 1 it is ensured that the toggle body 30 is at the extremity of screw 25, so that prior to engagement of the seal 10 with the tube upper end 4 the outer ends of toggle arms 32 clear the lower end of tube 1 to enable the toggle arms 32 to fall under gravity to a horizontal position, in which they are maintained by abutment of the respective surfaces 34 and 35. The length of screw 25 is chosen to accommodate a range of lengths of outlet tube 1.

With the valve member 15 in a raised position, a screw driver blade can then be inserted into the upper end of tube 1 to engage the head of screw 25, and the screw is tightened to draw the toggle assembly 29 upwards and bring the horizontal upper surfaces of toggle arms 32 to engage with the lower end of tube 1, as shown in FIG. 1. The screw 25 is further tightened slightly to draw frame 24 and valve seat member 7 downwards relative to tube 1 to compress seal 10 against the tube upper end 4 thereby to provide a reliable seal between the valve seat member 7 and the tube 1.

It will be seen from FIG. 1 that the arrangement of the upper half of the frame 24 as a C-shape enables the float shell 17 to be accommodated within the upper part of tube 1 yet permit ready access to the head of screw 25 when the valve member 15 is raised. Since the frame 24 and toggle assembly 29 are relatively slim when viewed in plan, the flow of water through the tube 1 during flushing is not significantly inhibited.

Figure 5:
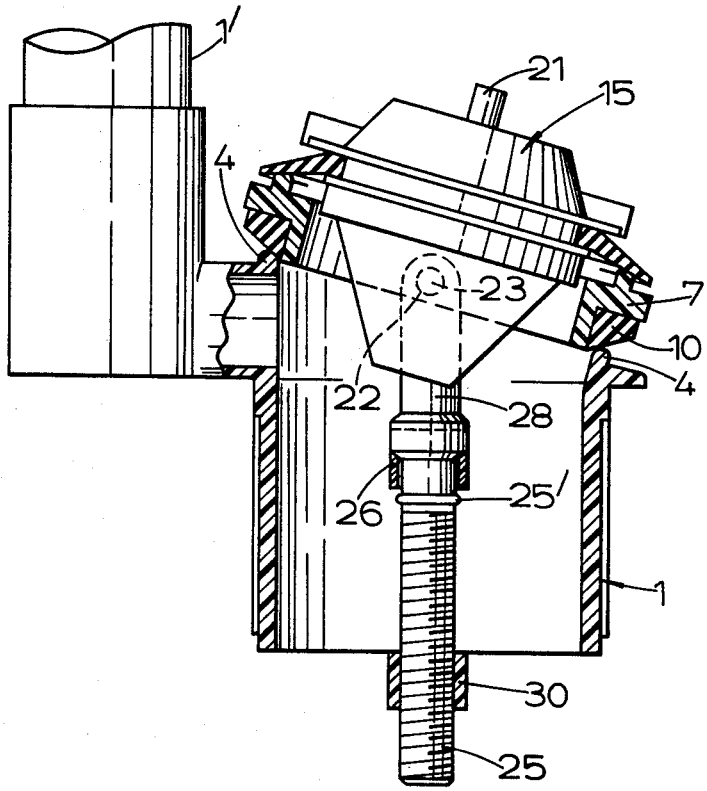
FIG. 5 is a cross-sectional view of the flush valve assembly of FIG. 1 mounted on an outlet tube having an inclined upper end, the section being taken in a vertical plane perpendicular to that of FIG. 1.

FIG. 5 shows the valve assembly of FIGS. 1 to 4 fitted to an outlet tube having an inclined upper end, and it will be seen that the pivotal connections 22, 23 between the frame 24 and the valve seat member 7 enables the frame to be oriented vertically whilst the valve seat member is tilted to fit the tube upper end 4. The triangular shape of seal 10 assists in location of the seal 10 against the inclined tube upper end 4.

Figure 6:
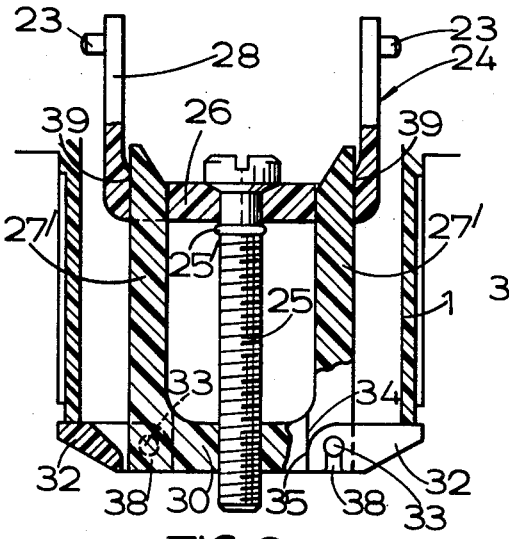
FIG. 6 is a view similar to FIG. 1 of the modified assembly.
Figure 7:
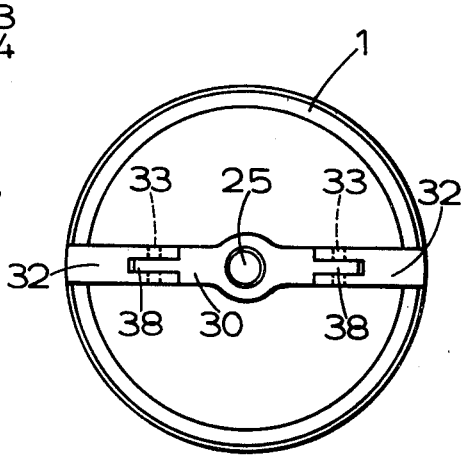
FIG. 7 is an under-plan view of the assembly of FIG. 6.

FIGS. 6 and 7 show a modified arrangement for the frame and toggle assembly in which the legs 27 of the FIG. 1 arrangement are replaced by upwardly extending arms 27' provided integrally on the toggle body 30 as upward extensions of respective pivot lugs 38. Corresponding reference numerals have been applied to parts corresponding to those of the FIG. 1 construction.

In this construction the toggle arms 32 are bifurcated to receive the respective pivot lugs 38, the right arm in FIG. 6 being shown in side view, whereas the left arm is shown in cross-section. The upper ends of the arms 27' are received in respective vertical slots 39 in the portion 26 of the frame 24 to hold the toggle body 30 against turning movement relative to the frame 24 during initial tightening of screw 25. The method of installation of the modified assembly is identical to that of FIG. 1.

It will be appreciated that the illustrated valve assemblies, although primarily intended as replacement assemblies, may be supplied as original equipment for a cistern.

We claim:

1. A flush valve seat assembly comprising an annular valve seat member provided on the upper surface thereof with an upwardly facing valve seat, a resilient sealing ring carried by said valve seat member and presenting a downwardly facing sealing surface for engagement with the annular upper end of a cistern outlet tube, a frame connected to and extending downwardly from said valve seat member for positioning substantially within said outlet tube, a downwardly extending screw carried by said frame, a toggle assembly carried by the lower end of said screw and comprising a toggle body threadedly engaged with said screw, at least one toggle arm, and a pivotal connection between said toggle body and said toggle arm to enable said toggle assembly to be passed through said outlet tube from the upper end thereof with said toggle arm pivotally retracted and said toggle arm to be extended to lie beneath the lower end of said outlet tube.

2. A flush valve seat assembly as in claim 1 wherein said pivotal connection has a pivotal axis which extends in a plane normal to the axis of said screw, and said toggle arm and said toggle body are provided with complementary stop faces for limiting downward pivotal movement of said arm.

3. A flush valve seat assembly as in claim 2 wherein said pivotal connection is sufficiently loose to enable said toggle arm under its own weight to pivot downwardly relative to said toggle body into an extended position in which said stop faces are engaged.

4. A flush valve seat assembly as claimed in claim 1 wherein said frame comprises a substantially C-shaped frame portion lying on its back with the free ends of the C secured to said valve seat member, said screw passing through the back of the C with the head of said screw positioned a substantial distance below the level of said sealing ring.

5. A flush seat valve assembly as claimed in claim 1 wherein said frame comprises abutment means engageable by said toggle assembly to prevent rotation of said toggle assembly about the axis of said screw on tightening of said screw.

6. A flush valve seat assembly as in claim 1 wherein said toggle assembly comprises two such pivoted toggle arms.

7. A flush valve seat assembly as in claim 6 wherein said toggle arms extend in opposite diametral directions from said screw, said frame comprises a pair of downwardly extending frame members, and said toggle arms are each provided with an aperture through which a respective one of said frame members slidably extends, whereby said toggle assembly is held by said frame against rotation about the axis of said screw, and said toggle arms are permitted to pivot relative to said toggle body.

8. A flush valve seat assembly as in claim 1 including a pivotal connection between said frame and said valve seat member to enable said sealing ring to seal against an outlet tube upper end that lies in a plane inclined with respect to the axis of the outlet tube.

9. A self-contained flush valve assembly comprising in combination the flush valve seat assembly as in claim 1, a valve member support carried by said valve seat member. a valve member sealingly engageable with said valve seat, and a pivotal connection between said valve member support and said valve member, whereby said valve member is pivotally supported by said flush valve seat member.

* * * * *